US005836363A

United States Patent [19]

LaFleur

[11] Patent Number: 5,836,363

[45] **Date of Patent: *Nov. 17, 1998**

[54] TANK LINER

[75] Inventor: Lee LaFleur, Manistee, Mich.

[73] Assignee: Custom Packaging Systems, Inc., Manistee, Mich.

[ * ] Notice: The term of this patent shall not extend beyond the expiration date of Pat. No. 5,794,670.

[21] Appl. No.: 850,294

[22] Filed: May 5, 1997

Related U.S. Application Data

[63] Continuation-in-part of Ser. No. 701,863, Aug. 23, 1996.

[51] Int. Cl.[6] ..... B65B 1/04

[52] U.S. Cl. ..... 141/314; 141/10; 141/114; 220/403

[58] Field of Search ..... 141/114, 10, 313–317, 141/65; 220/403, 404, 460, 461, 465; 383/41, 66, 67; 222/105

[56] References Cited

U.S. PATENT DOCUMENTS

| | | | |
|---|---|---|---|
| 3,097,677 | 7/1963 | Mitchell | 141/317 |
| 3,918,605 | 11/1975 | Butler | 220/63 |
| 4,635,814 | 1/1987 | Jones | 220/403 |
| 5,154,308 | 10/1992 | Larson | 220/403 |

FOREIGN PATENT DOCUMENTS

| | | |
|---|---|---|
| 2453795 | 7/1980 | France . |
| 9214121 | 3/1993 | Germany . |
| 1104502 | 2/1968 | United Kingdom . |

*Primary Examiner*—Steven O. Douglas
*Attorney, Agent, or Firm*—Barnes, Kisselle, Raisch, Choate, Whittemore & Hulbert, P.C.

[57] ABSTRACT

A collapsible container liner for use within a bulk container having a substantially rigid top, bottom and side walls and a filler opening in the top wall. The liner is a collapsible bag of a flexible material with top, bottom and sides which correspond to the container walls within the interior of the container. A first opening in the liner top corresponds to the filler opening in the container top wall. A seal is formed between the container top wall and the liner top around the periphery of the filler opening and the first opening. Optionally, the container bottom wall can be formed with a discharge outlet lined by a complementarily shaped liner discharge spout sealed adjacent thereto. A second opening in the liner top is spaced from the first opening and has an evacuation outlet attached to the liner top around the periphery of the second opening. Air is withdrawn through the evacuation outlet from the space between the liner and the interior of the container, a vacuum forms which collapses the liner against the container interior surfaces. A removable cap is sealably received in the evacuation outlet to maintain the evacuated condition within the space so that the liner retains its shape conforming to the interior configuration of the container.

20 Claims, 3 Drawing Sheets

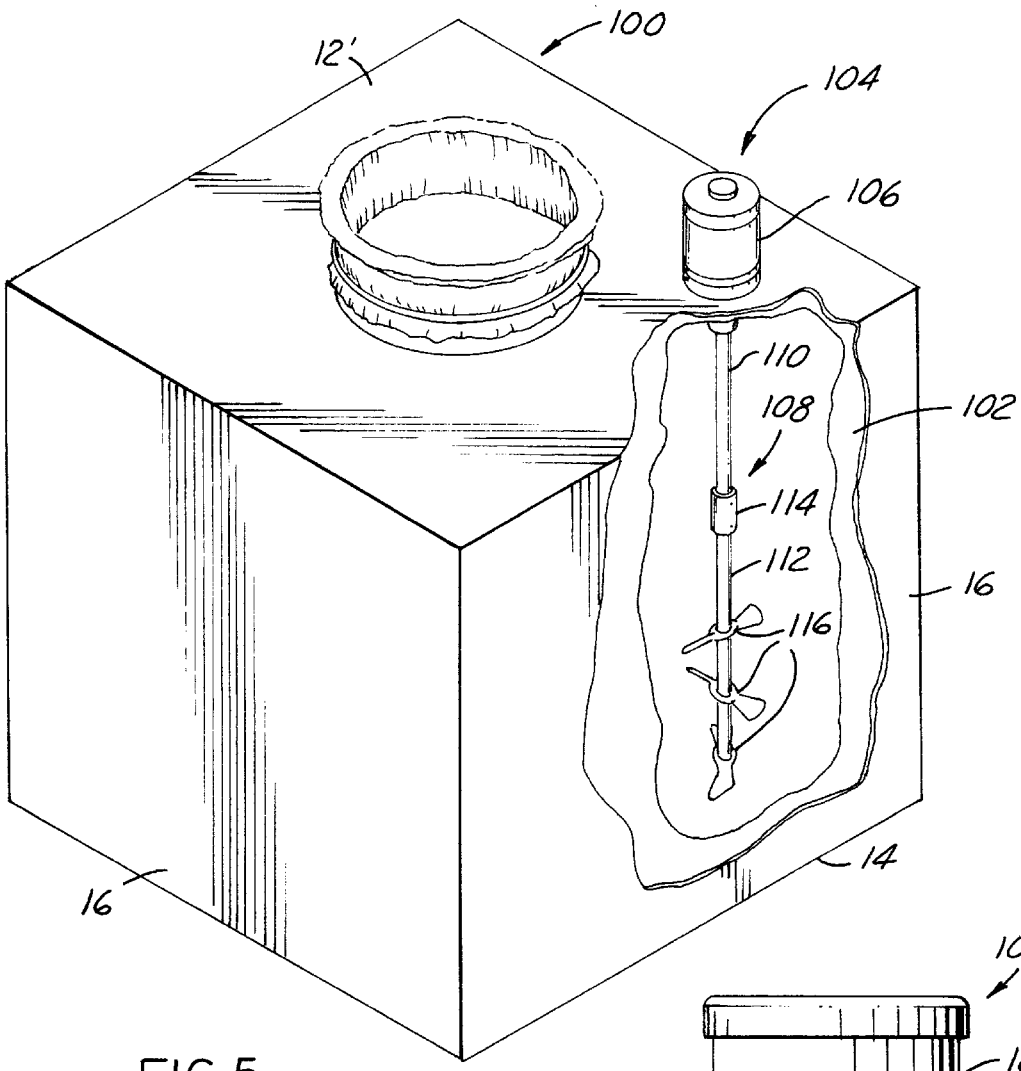
FIG.5
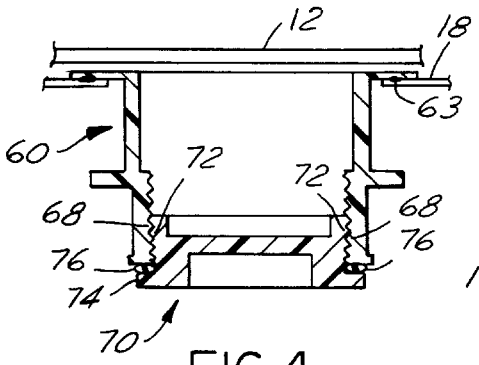
FIG.4
FIG.6
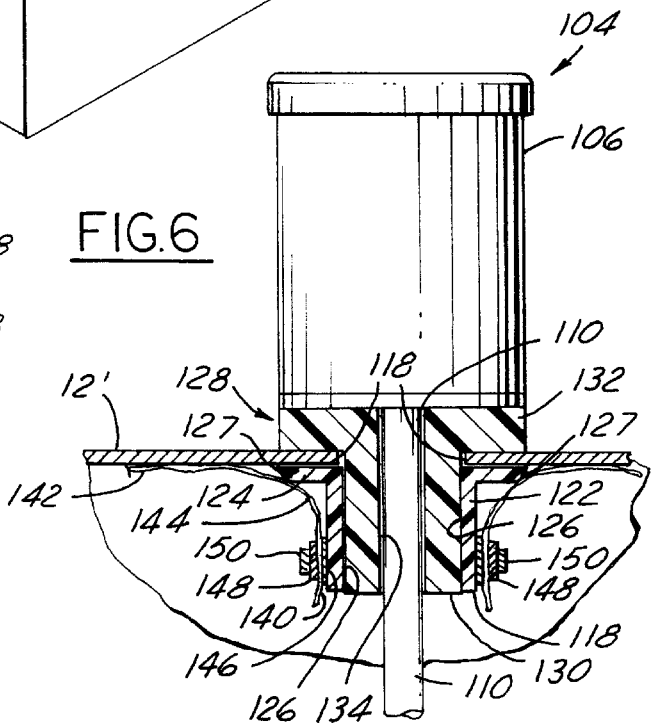

TANK LINER

REFERENCE TO A COPENDING APPLICATION

This is a continuation in part of copending U.S. patent application Ser. No. 08/701,863, filed on Aug. 23, 1996.

FIELD OF THE INVENTION

This invention relates to flexible bag liners for use in a bulk container, and more particularly to a liner that conforms to the interior configuration of a container and method of installing the liner in the container.

BACKGROUND OF THE INVENTION

Flexible bags are frequently used to line tanks and other rigid containers to hold various types of liquids and flowable solids. Such bag liners are advantageous because they reduce or eliminate cleanup of the containers, enable highly caustic, acidic, or other chemically reactive or hazardous materials to be stored without damaging the container, and are relatively cost effective. However, when filling a container with a liquid, the liner may pull away from the container walls forming air bubbles between the liner and container and creases in the liner as the fluid level begins to fill the container. As the fluid level within the tank nears maximum volume, the fluid pressure may cause rips or tears in the liner at the location of the air bubbles and creases. Fluid may then leak through the perforations and into the space between the container and liner eliminating the benefit of the liner and soiling or even damaging the container.

SUMMARY OF THE INVENTION

A collapsible bag liner of a flexible material for use within a bulk container which has substantially rigid top, bottom and side walls and a filler opening in the top wall. The liner has a top, bottom and sides which correspond to the container walls. A first opening in the liner top corresponds to the filler opening in the top container wall. A seal is formed between the top container wall and the liner top around the periphery of the filler opening and the first opening. A second opening in the liner top is spaced from the first opening and has an evacuation outlet sealably attached to the liner top around the periphery of the second opening. A removable cap is sealably received in the evacuation outlet. In another embodiment, a discharge outlet is provided in the bottom container wall to facilitate emptying the container and the liner has a corresponding opening and is sealed to the container adjacent to the discharge outlet.

The liner is disposed within the container and preferably much of the air between them is removed before the seal is formed around the periphery of the filler opening and the first opening in the liner to seal off the space between the container and liner from outside air. The air may be removed by expanding the liner or forcing its bottom and side walls to lie closely adjacent the corresponding container walls while permitting the air to escape between the container filler opening and the liner. The liner may be expanded by supplying a large volume of air at slightly superatmospheric pressure to the interior of the liner such by using a blower or fan and preferably a "leaf blower" typically used for lawn and garden leaf removal.

After the space is sealed the cap is removed from the evacuation outlet and a hose connected to a pump is attached to the outlet for evacuating the air from the space between the container and liner. As the air is evacuated, the liner is drawn toward and collapses against the interior walls of the container and conforms to the interior shape. The hose is then removed from the evacuation outlet while the outlet is pressed against the inside surface of the top container wall to maintain the evacuated condition in the space. The cap is then reinstalled on the evacuation outlet to seal the evacuated space. The liner remains in contact with the container and conforms to the interior container configuration.

Objects, features and advantages of this invention are to provide a liner which nay be easily installed in a container with a minimum of manual effort, is conformable to the interior configuration of the container, reduces the frequency of liner failure by significantly reducing the occurrence of air bubbles and creases in the liner, and is lightweight, reusable, strong, rugged, durable, of simple design and economical manufacture and is easy to use.

BRIEF DESCRIPTION OF THE DRAWINGS

These and other objects, features and advantages of this invention will be apparent from the following detailed description of the preferred embodiment and best mode, appended claims, and accompanying drawings in which:

FIG. 4 is a fragmentary sectional view of the evacuation outlet having a cap installed therein;

FIG. 5 is a perspective view of a bulk container broken away to illustrate a mixing apparatus installed in the container;

FIG. 6 is a fragmentary sectional view of the attachment of the mixing apparatus to the container showing the liner seal around the mixing apparatus attachment;

DETAILED DESCRIPTION OF THE PREFERRED EMBODIMENTS

Figure 1:
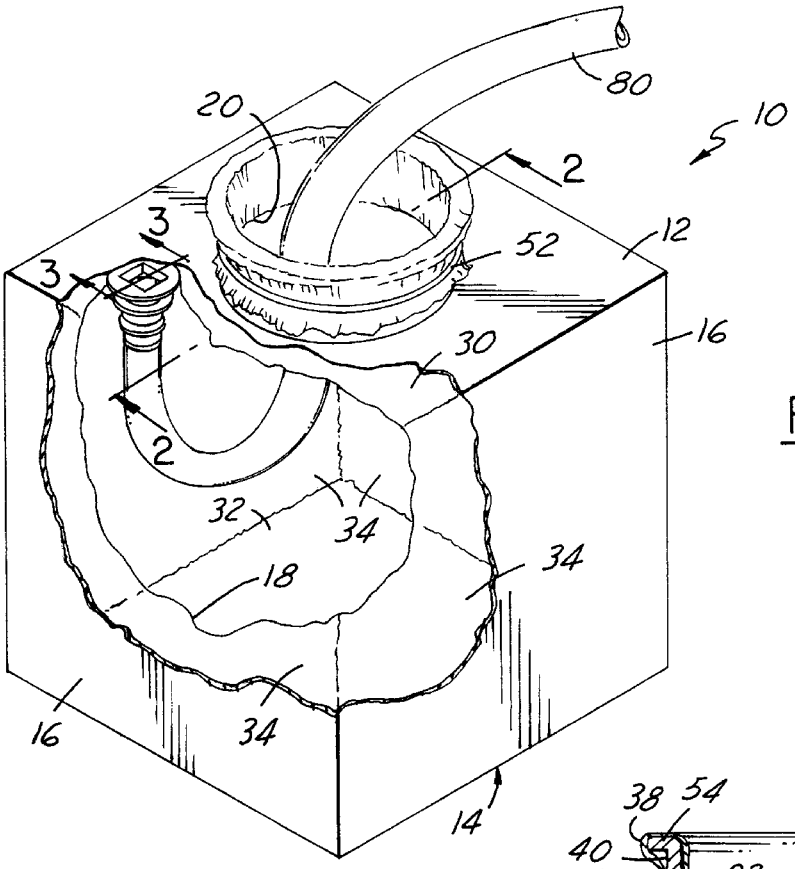
FIG. 1 is a perspective view of a bulk container broken away to illustrate a liner in the container constructed in accordance with the present invention.
Figure 2:
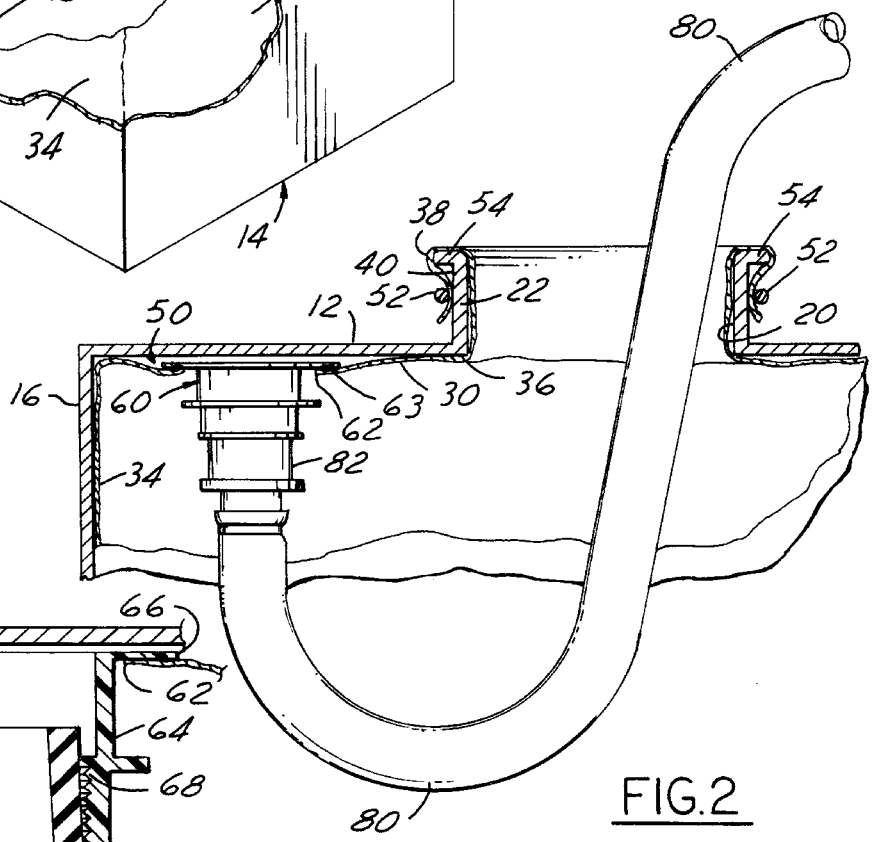
FIG. 2 is a fragmentary sectional view taken along line 2—2 of FIG. 1 showing the evacuation outlet and evacuation hose of the liner.
Figure 3:
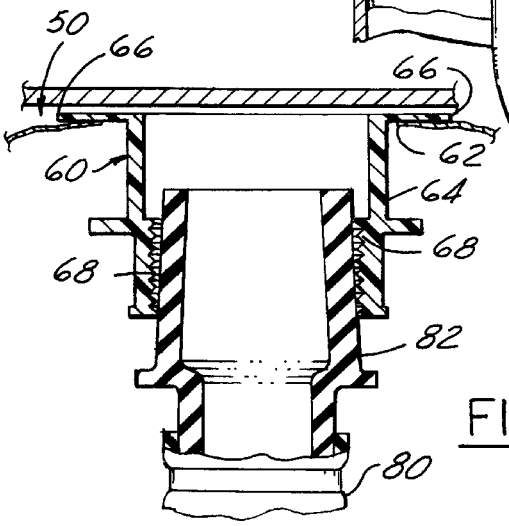
FIG. 3 is a fragmentary sectional view of the evacuation outlet and the attached evacuation hose taken along line 3—3 of FIG. 1.

Referring in more detail, to the drawings, FIGS. 1–3 illustrate a bulk container 10 having a substantially rigid construction. The container 10 has a top wall 12, a bottom wall 14 and side walls 16 to receive and support a flexible bag liner 18 therein. Preferably, the side walls 16 and bottom walls 14 are each of one-piece construction, and independently capable of containing the contents of the bag 18.

The top wall 12 has a filler opening 20 for receiving the contents to be stored within the container. The opening 20 may be encompassed by a collar 22 around the periphery of the filler opening. If desired, the container 10 may be a housing, tank, collapsible container, or any other receptacle capable of receiving and supporting the bag 18.

Preferably, the flexible bag liner is conformable to the interior shape of the container 10 and is constructed of a flexible material impervious to its intended contents such as low or high density polyethylene, polypropylene or other plastic material. The liner 18 has a liner top 30, a liner bottom 32 and liner sides 34 each corresponding in size and shape to the top wall 12, bottom wall 14 and side walls 16, respectively, of the container. The liner top 30 has a first opening 36 therein coaxially aligned and cooperating with the filler opening 20 of the container top wall 12 for permitting storage material to be received through the first opening and the filler opening and into the liner 18.

Preferably, a flexible filling spout 38 is attached to the liner top 30 around the periphery of the first opening 36 which extends sufficiently upward from the liner top 30 such that it can be folded over the collar 22 and extend downward along the collar outside surface 40. The filling spout 38 aligns the bag 18 with the filler opening 20 and also aids in forming a seal, to be described herein, which is necessary for the present invention.

According to the present invention and to conform the bag liner 18 to the interior configuration of the container 10 prior to filling the container with material, air must be evacuated from the space 50 between the bag 18 and the container 10. To seal off the space 50 from outside air, a circumferentially continuous elastomeric band 52 such as a "rubber band" is stretched over the outside surface 40 of the collar 22 and over the filling spout 38, to urge the portion of the spout 38 underlying the band 52 into engagement with the collar 22 forming an air tight seal. To retain the band 52 on the collar 22, preferably a radially outwardly extending flange 54 is formed on the upper most end of the collar. If desired, an annular groove may be formed in the outside surface 40 of the collar 22 for receiving the band 52 to positively position the band and provide an improved air tight seal.

According to the present invention, an evacuation outlet 60 is received in a second opening 62 in the liner top 30 spaced from the first opening 36 such that the outlet can be easily accessed by manually reaching through the filler opening 20 and the first opening 36. The outlet 60 preferably has a generally cylindrical tube 64 depending downward from the liner top 30 into the interior of the liner 18. The outlet 60 has at one end a radially outwardly extending flange 66 of a larger diameter than the second opening 62 which is disposed at the top end of the outlet 60 and overlaps the liner top 30 around the periphery of the second opening. The flange 66 is preferably sealed and permanently affixed to the exterior surface of the liner top 30 around the entire periphery of the second opening 62 by a circumferentially continuous heat or adhesive seal 63.

As shown in FIG. 4, at the opposite end of the tube 64, mechanical threads 68 are formed on the interior surface of the outlet 60 for receiving a cap 70 therein. The cap 70 has a threaded end with complimentary threads 72 formed on an outer surface for mechanically engaging with the threads 68 within the tube 64. The other end of the cap 70 has a larger diameter head 74 which can be easily gripped and rotated by hand to install or remove the cap from the outlet. An O-ring seal 76 or other seal or gasket is fitted over the threads 72 of the cap 70 and abuts the head 74 for providing a seal when the cap is installed on the outlet 60.

To utilize the present invention, the liner 18 is inserted into the container 10 through the filler opening 20 and preferably much of the air between them is removed by expanding or opening the liner so that its bottom and side walls lie closely adjacent their corresponding container walls while permitting the air to escape between the container filler opening 20 and the liner. Preferably, the liner is extended by discharging a relatively large volume of air at slightly superatmospheric pressure into the liner to force its walls generally outward. Preferably, this air is supplied by a blower or fan such as a "leaf blower" typically used for lawn and garden leaf removal. Of course this step may be eliminated and all the air removed through the liner evacuation outlet 60.

The filling spout 38 is pulled up over the collar 22 and folded over the top of the collar such that it hangs downward along the collar outside surface 40. The elastomeric band 52 is then stretched over the flange 54 on the collar 22 and then released such that it holds the filling spout 38 against the collar outside surface 40 forming an air tight seal.

The cap 70 is manually removed from the evacuation outlet 60. A hose 80 communicating with an external pump (not shown) and having a connector 82 at its end remote from the pump is connected to the evacuation outlet 60, as shown in FIGS. 1–3. Air is withdrawn from the evacuated source 50 through the outlet 60, the connector 82 and the hose 80 by the pump. As the air is withdrawn from the space 50, the vacuum within the space causes the liner 18 to be drawn towards and conform to the interior surfaces of the container 10. To reseal the outlet 60 and maintain the vacuum within the space 50, the connector 82 is removed from the outlet 60 while the flange 66 of the outlet 60 is pressed against the interior surface of the container top wall 12. The outlet is held against the top wall until the cap 70 is reinstalled and the O-ring seal 76 abuts the end of the outlet sealing off the evacuated space 50 from outside air. The liner 18 will maintain the condition of being conformed to the interior surfaces of the container 10 until the evacuated source 50 no longer is sealed from outside air.

As shown in FIGS. 5 and 6, it is common for a bulk container 100 to include an attached mixing device for mixing the contents stored within the container. In this alternative embodiment, the container 100 and flexible bag liner 102 are substantially as described above and therefore will not be described in detail herein. The container 100 has a mixing apparatus 104 with a motor assembly 106 for driving an attached mixing shaft 108. To facilitate installation and removal, the shaft 108 has an upper section 110 and a lower section 112 releasably connected by a coupling 114 which is affixed to the upper end of the lower section 112. At the other end of the lower section 112 are a plurality of mixing blades 116 affixed thereon for stirring the contents within the container.

The mixing apparatus 104 is partially received in the container 100 through a mixer opening 118 in the container top wall 12'. For supporting the mixing apparatus 104, a rigid collar 122 depends from the interior surface of the top wall 120 and has a radially outwardly extending flange 124 at its upper end and a longitudinal bore 126 extending the length of the collar. The bore 126 is positioned coaxially with the mixer opening 118 and is attached to the interior surface of the top wall 12' by a weld 127 around the periphery of the flange 124.

A mounting grommet 128 is disposed between the motor assembly 106 and the top wall 120 providing noise insulation and vibration damping. The grommet 128 includes a depending portion 130 passing through the mixer opening 118 the entire length of the collar bore 126 and a shoulder 132 at its upper end with a diameter larger than the mixer opening. A shaft bore 134 extends longitudinally through the grommet 128 for receiving the upper section 110 of the mixing shaft 108 therethrough. The shoulder 132 rests on the top wall 12' around the periphery of the mixer opening 118 and supports the mixing apparatus thereon.

The liner 102 is constructed essentially the same as the liner 18 described above but includes a third opening 140 in the liner top 142 generally positioned coaxially with the mixer opening 118 and rigid collar 122. The third opening 140 has a downwardly extending neck 144 depending about the length of the rigid collar 122. Preferably, to insure a good seal between the collar 122 and the neck 144, a rubber band 146 is received around the collar to provide a ring of resilient material engaging the collar. A seal such as an O-ring or a rubber band 148 is received around the collar 122 to urge the neck 144 against the outside of the band 146 forming an air tight seal. The seal is necessary to maintain the evacuated condition within the space 50 so that the liner 102 conforms to the interior configuration of the container 100 when the space 50 is evacuated as previously described. Preferably, a hose clamp 150 is secured over the rubber band 148 to insure that the neck 144 is not pulled away from the collar and to enhance the seal.

Figure 7:
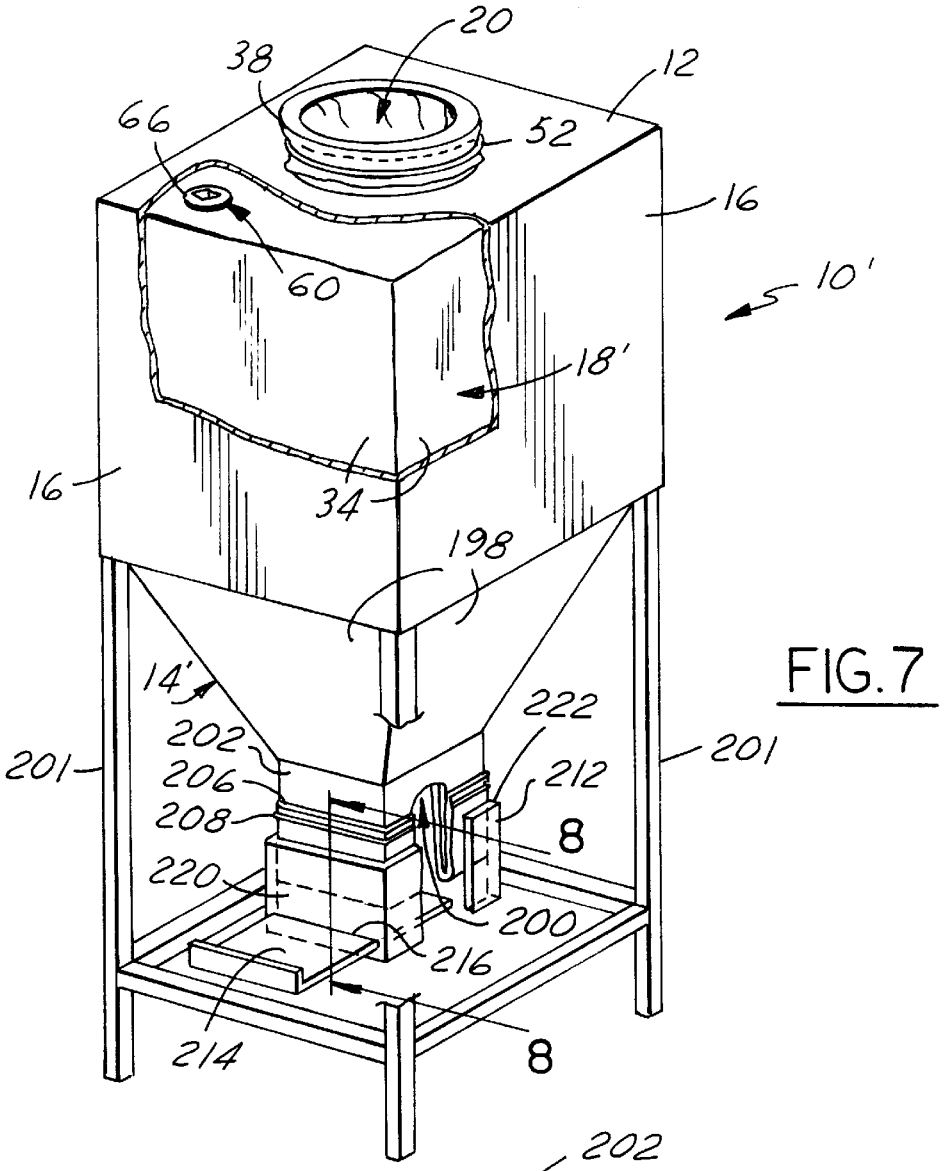
FIG. 7 is a perspective view of another bulk container with portions broken away to illustrate a liner in the container constructed in accordance with another embodiment of the present invention.

As shown in FIG. 7, in another embodiment, a bulk container 10' for liquid or granular substances has sloped bottom wall panels 198 forming a frustum shaped bottom wall 14' with a central discharge outlet 200 formed by a collar 202 for emptying the container 10'.

The container is supported by four spaced apart and upstanding legs 201 adjacent its comers. A complementarily shaped liner 18' is received in the container and has an opening 204 in communication with the discharge outlet 200. The liner 18' has a complementarily shaped discharge spout 206 received through the collar 202 and folded over the edge of the collar 202 to completely isolate the interior surface of the collar 202 and bottom container wall 14' from the contents of the liner 18'. To provide a seal between the liner discharge spout 206 and container 10' adjacent the discharge outlet 200 a band 208 of an elastomeric material such as rubber is stretched over the collar 202 and discharge spout 206 and then released to hold the discharge spout 206 against the collar outside surface 210 forming an air tight seal.

Figure 8:
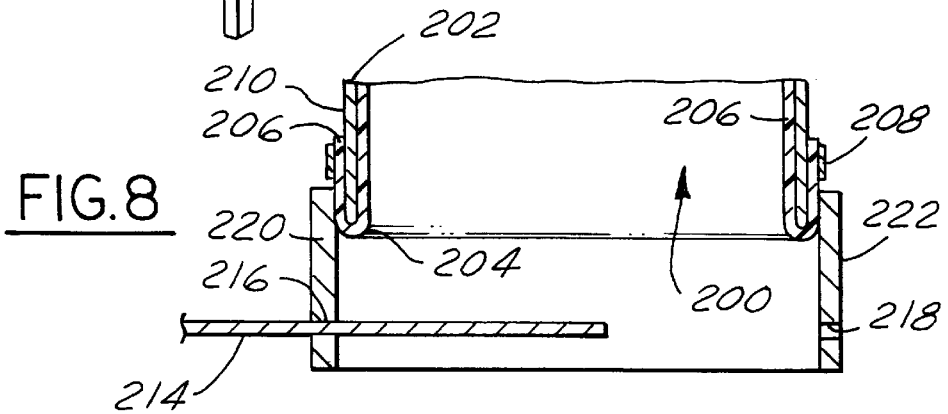
FIG. 8 is a fragmentary sectional view of the discharge chute and gate installed on the container of FIG. 7.

Optionally, as shown in FIG. 8, to close the discharge outlet 200 when desired and to control the discharge of the contents of the liner 18', an open ended discharge chute 212 is telescopically received on the collar 202 and has a gate 214 slidably received in slots 216, 218 formed in opposed walls 220, 222 of the chute 212 to selectively permit discharge of the contents of the liner 18'. Preferably, the rubber band 208 is still utilized to seal the discharge spout 206 to the collar 202, although the seal may also be provided by providing a close-fit between the chute 212 and collar 202 to trap the discharge spout 206 between them and provide the necessary air-tight seal.

In use, after the discharge spout 206 is sealed against the adjacent collar 202, the air between the liner 18' and the container 10' can be removed or the liner 18' expanded as previously described to urge the liner 18' against the inside surfaces of the container. When it is desired to empty a filled container 10', the gate 214 can be slidably displaced to partially or fully open the discharge chute 212 and permit the contents to flow out of the liner 18'.

I claim:

1. For use within a bulk container having a substantially rigid top container wall, bottom container wall and side container walls and a filler opening in said top container wall, a collapsible container liner comprising, a collapsible bag of a flexible material having a liner top, a liner bottom, and liner sides which correspond to said container walls within said bulk container and a first opening in said liner top disposed generally coaxially with said filler opening, a seal between said top container wall and said liner top around the periphery of said filler opening and said first opening for sealing off the space between said liner and said container, a second opening in said liner top spaced from said first opening, an evacuation outlet sealably attached to said liner top around the periphery of said second opening for evacuating said space through said second opening, and a cap removably and sealably received in said outlet.

2. The liner of claim 1 wherein said evacuation outlet comprises a tube with a radially outwardly projecting flange at its upper end and its opposite end depends downward into said liner.

3. The liner of claim 2 wherein said flange overlaps said liner around the periphery of said second opening and is permanently affixed thereto.

4. The liner of claim 2 wherein said tube has internal threads formed in said opposite end.

5. The liner of claim 4 wherein said cap has external threads formed thereon for engaging said internal threads of said tube.

6. The liner according to claim 1 wherein said seal comprises an upwardly extending collar around said filler opening, an upwardly extending spout around said first opening folded over said collar to overlap the outside of said collar, and a band of elastomeric material fitted around said collar trapping said spout between said band and said collar.

7. The liner of claim 1 wherein said bottom container wall has an opening therethrough and said liner bottom has a corresponding opening generally coaxially aligned with said opening in the bottom container wall and a seal disposed between the liner and the container about the periphery of said opening in the bottom container wall.

8. The liner of claim 7 wherein said liner extends through said opening in said bottom container wall and said seal is disposed about the exterior surface of said container.

9. The liner of claim 8 wherein said bottom container wall has a downwardly extending collar and said liner has a portion constructed to be received through said opening in said bottom container wall and folded over said collar to overlap the outside of said collar and said seal is provided by a band of an elastomeric material fitted around said collar and trapping said portion of said liner between said band and said collar.

10. The liner of claim 9 wherein said container also comprises a discharge chute having a pair of open ends with one end received adjacent said collar in telescopic relationship and the other end selectively communicated with the interior of the liner by a valve member movable between open and closed positions to control the discharge of the contents of the liner.

11. The liner of claim 10 wherein said discharge chute is press-fit onto said collar to trap said portion of said liner between said discharge chute and said collar to provide a seal therebetween.

12. The liner of claim 10 wherein said valve member comprises a gate slidably received in a slot through said discharge chute.

13. The liner of claim 12 wherein said discharge chute has a pair of slots with one in each of two opposed walls, each slot is constructed to slidably receive said gate to allow said gate to be removably inserted through said discharge chute to selectively close said other end of said discharge chute to prevent the discharge of the contents of the liner.

14. The liner of claim 7 wherein said bottom container wall is generally frustum shaped and said liner bottom is complementarily shaped and constructed to be received closely adjacent said container.

15. The liner of claim 14 wherein said liner has a portion extending through said opening in said bottom container wall and exteriorly of said container and said seal is disposed between said portion of said liner and said container exteriorly of said container.

16. The liner of claim 15 wherein said seal is provided by a band of an elastomeric material fitted around said portion of said liner and trapping it between said band and said bottom container wall.

17. A method of installing a flexible bag liner in a bulk container such that it conforms to the interior contour of said container comprising the steps of:

a. providing a bulk container having substantially rigid top, bottom and side container walls and a filler opening in one of said container walls, b. providing a flexible bag liner having a liner top, liner bottom and liner side walls which substantially conform to said top, bottom and side container walls of said bulk container, a first opening in one of said liner walls which corresponds to said filler opening of said container and a second opening in said liner spaced from said first opening, c. inserting said liner into said bulk container and sealing said liner to said container around the periphery of said first and filler openings, d. evacuating the air from the space between said liner and said container through said second opening such that said liner abuts and conforms to the contour defined within said container walls, and e. sealing said second opening such that said space remains evacuated.

18. The method of claim 17 wherein said liner of step b. further comprises an evacuation outlet attached to said liner in cooperation with said second opening.

19. The method of claim 18 wherein said evacuation outlet of step b. further comprises a cap removably and sealably received in said outlet.

20. The method of claim 19 wherein step e. further comprises inserting said cap into said outlet to seal said evacuated space.

* * * * *